US005979216A

United States Patent [19]

Schretter et al.

[11] Patent Number: 5,979,216

[45] Date of Patent: Nov. 9, 1999

[54] WEAR RESISTANT TOOL INSERT

[75] Inventors: Michael Schretter, Ehrwald; Markus De Monte, Nesselwangle; Thomas Ginther, Vorderhornbach; Reinhard Posch, Weissenbach, all of Austria

[73] Assignee: Schwartzkopf Technologies, Corp., Franklin, Mass.

[21] Appl. No.: 09/049,586

[22] Filed: Mar. 27, 1998

[30] Foreign Application Priority Data

Apr. 9, 1997 [AT] Austria ..... 210/97 U

[51] Int. Cl.[6] ..... B21J 13/02; B21H 3/02

[52] U.S. Cl. ..... 72/478; 470/10; 470/84; 470/185; 72/481.8

[58] Field of Search ..... 470/10, 84, 85, 470/27, 33, 185, 187, 190; 72/478, 481.8

[56] References Cited

U.S. PATENT DOCUMENTS

| | | | |
|---|---|---|---|
| 228,033 | 5/1880 | Burke | 470/10 |
| 357,768 | 2/1887 | Furbish | 470/10 |
| 377,981 | 2/1888 | Becher | 470/10 |
| 739,873 | 9/1903 | Howe | 470/10 |
| 740,016 | 9/1903 | Howe | 470/10 |
| 986,697 | 3/1911 | Deeds | 470/10 |
| 996,840 | 7/1911 | Deeds | 470/10 |
| 2,652,577 | 9/1953 | Chiaberta | 470/10 |

*Primary Examiner*—David Jones
*Attorney, Agent, or Firm*—Morgan & Finnegan LLP

[57] ABSTRACT

A wear-resistant tool insert for machines used in the manufacture of nails, screws, rivets and similar items from a wire starting material. The tool insert is of divided design in the axial direction of the supplied wire. Thus, during application of the tool insert it can "flex" in a controlled manner thereby reducing tensile stress in the tool insert, and reducing the possibility of fracture or breakage of the tool insert, when employed in an overload condition with unacceptably large tensile loads.

4 Claims, 2 Drawing Sheets

WEAR RESISTANT TOOL INSERT

BACKGROUND OF THE INVENTION

1. Field of the Invention

This invention pertains to a wear-resistant tool insert for machines used in the production of nails, screws, rivets and similar objects starting with wire material.

2. Description of Related Art

Wear-resistant tool inserts of this type are employed in pairs in machines and are called impact or clamping jaws and pincer jaws. The clamping jaws are often used as inserts in toolholders. The inserts have elongated, prism-like trapezoidal cross-section base elements corresponding to similar recesses in the toolholders. One working surface of the clamping jaws has one or more clamping grooves for tightly clamping the supplied wire, and also a recess for forming the desired head shape of the object to be produced. The clamping jaws are arranged in the machine so that the clamping grooves are located opposite the paired inserts. In the course of the machine operation, the clamping jaws are closed or opened. In the closed state, the supplied wire is tightly clamped in the clamping grooves. In the clamped state, the head of the nail, screw or rivet is formed. For better clamping of the supplied wire, the clamping grooves are preferably transverse and semicircular in form.

After completion of the head, the part is elongated by closing two opposing pincer jaws. The pincer jaws are clamped tightly in toolholders or directly in the machine. They have a symmetrical profile with several cuts, through which, on the one hand, the end of the finished part is shaped and the part is elongated, and on the other at the same time, the initial geometry is created to shape the head of the next part.

A distinction is made, between single-wire and dual-wire clamping jaws, where either one or two clamping grooves are provided side by side.

The dual-wire form makes possible a simultaneous production of two nails, screws or rivets, that is, the production capacity is doubled. The pincer jaws are, as a rule, always of single-wire design, so that four pincer jaws are used in association with two-wire clamping jaws.

The tool inserts are often manufactured of hard metal to reduce wear. If the wear on the clamping grooves or on the cutters is excessive, then the inserts must be replaced.

Hard metal and other hard, wear-resistant materials indeed have a high compression strength and a very great hardness and thus a great wear resistance, but they can withstand only moderate tensile and bending loads. Based on irregularities in wire quality in connection with varying dimensions or different strengths in the manufacture of nails, screws, or rivets, very large tensile loads, and thus over stressing of the inserts of wear-resistant material may occur, which often is associated with fracturing of the inserts.

SUMMARY OF THE INVENTION

It is therefore an object of this invention to address the problem of creating wear-resistant tool inserts for machines for the manufacture of nails, screws, rivets and such, in which an impermissible overload due to excessive tensile stresses results in premature fracture of the tool insert.

It is a further object of this invention that the tool insert is of divided design in the axial direction of the supplied wire. In this manner, the attained advantage is that the insert of wear-resistant material can "flex" in a controlled manner in case of overload, so that impermissibly large tensile loads, which could lead to fracturing of the insert, can be avoided.

It is a further object of this invention that the single parts of the tool insert are connected to each other by a rivet or a screw.

It is a further object of this invention that the single parts of the tool insert are pressed together by means of the toolholder or the machine part in which they are employed.

It is a further object of this invention that the single parts of the tool insert are connected to each other by means of at least partly toothed or serrated surfaces. This embodiment is advantageous particularly when no connecting elements, such as screws or rivets, are provided for connection of the single parts. Due to the serrated profile, forces in the direction of the contact pressure on the wire are absorbed, and a particularly good positive fit of the single parts with each other is achieved.

It is a further object of this invention that hard metal is used as a particularly favorable material for the tool insert, the hardness being of at least 1.500 (HV30), as measured in a Vickers test.

This invention is further described with reference to the Figures. It will be understood by those of ordinary skill that the embodiments described and illustrated serve as examples of this invention and that other embodiments will similarly accomplish the same objectives. Though not specifically illustrated or described in this specification, it is further intended and understood that all other embodiments, accomplishing the same objectives, are intended to be covered and claimed in this application.

DETAILED DESCRIPTION

Figure 1:
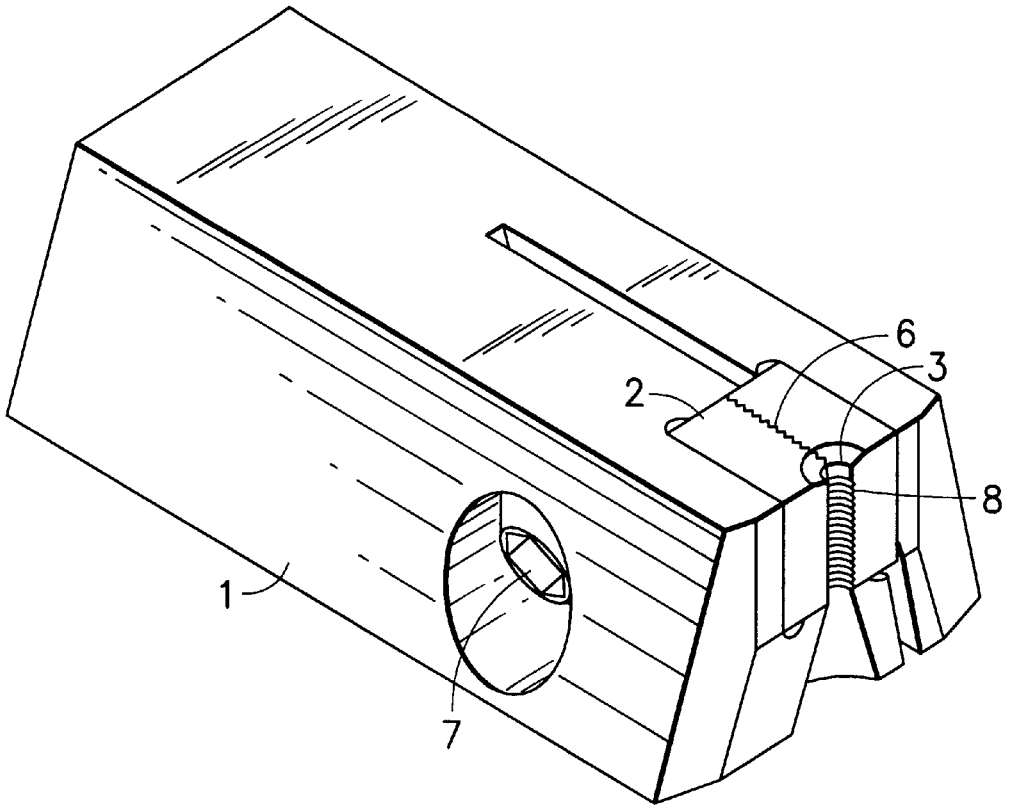
FIG. 1 An impact jaw for the manufacture of nails with a tool insert according to the present invention in an oblique view.

FIG. 1 shows a nail impact jaw consisting of an elongated, prism-like base element (also called a tool holder) 1 with an insert 2 of hard metal on one end. The insert according to this embodiment of the present invention is cube-shaped and can be clamped in a recess of the base element and can also be removed from said recess. Proceeding from the recess for the insert, a slot is installed in the base element 1 in the middle in a longitudinal direction. Transverse to this slot the base element 1 has a clamping screw 7 which is used to draw together the sections of the base element 1 separated by the slot, thus, the insert 2 can be tightly clamped in the recess. The insert 2 has a clamping groove 3 with transverse grooves 8 in its front shell surface, through which the inserted wire for nail production is clamped. The insert 2 is symmetrically divided in the longitudinal direction of the clamping groove 3. Due to the clamping force acting on the insert 2 due to the base element 1, two parts are pressed against each other. To improve the mutual form fit of the two parts, the connecting surfaces have partially toothed surfaces, or a serrated profile 6. During use, the tool insert illustrated in this figure normally mates with another similar tool insert to create the clamping action.

Figure 2:
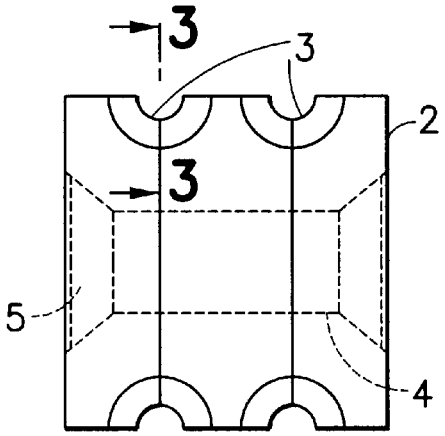
FIG. 2 A variant of the tool insert of one invention for a nail impact jaw, in a top view.
Figure 3:
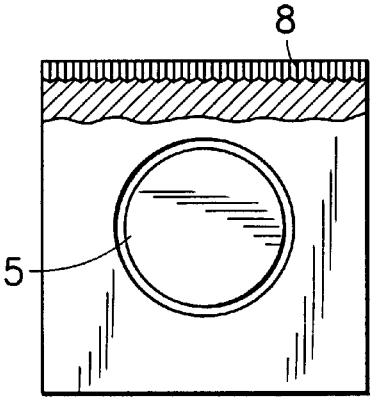
FIG. 3 The insert according to FIG. 2 in a partial cross-sectional side view.

In FIGS. 2 and 3 we see one variant of the insert 2 of the invention. The cube-shaped insert 2 has on two opposing shell surfaces, two clamping grooves 3 each running parallel and symmetrical to each other. The insert 2 is of divided design in the longitudinal direction of two opposing clamping grooves 3. The insert 2 has an opening 4 that is bored through in the middle transverse to the clamping grooves 3. The three parts of the insert are connected to each other by means of a rivet or screw 5 through the opening 4.

Figure 4:
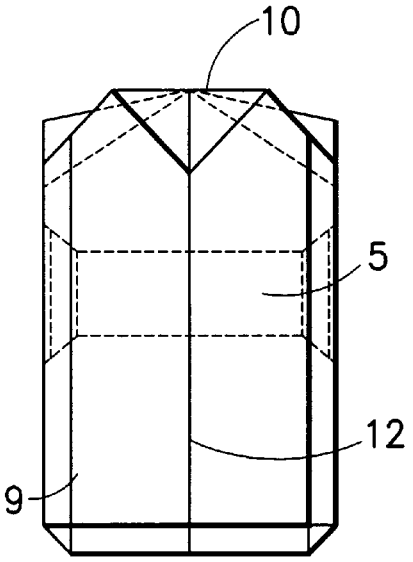
FIG. 4 A tool insert according to the present invention for a pincer jaw for the manufacture of nails shown in a front view.
Figure 5:
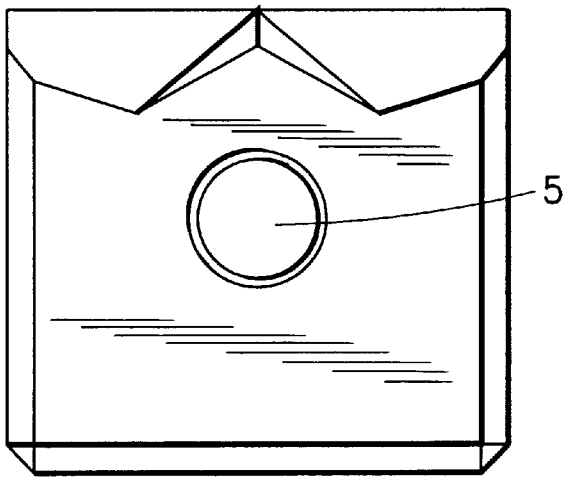
FIG. 5 A tool insert according to the present invention for a pincer jaw for the manufacture of nails shown in a side view.
Figure 6:
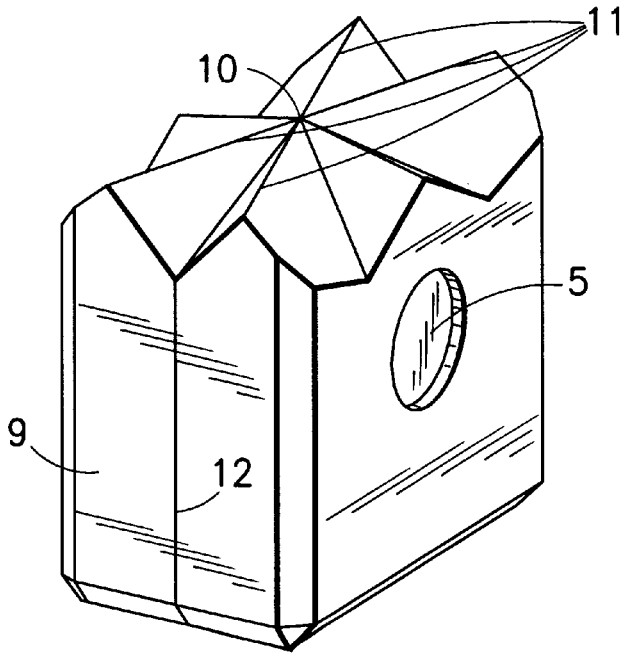
FIG. 6 A tool insert according to the present invention for a pincer jaw for the manufacture of nails shown in an oblique view.

FIGS. 4 to 6 show an insert 9 according to the present invention for a pincer jaw for the manufacture of nails with a symmetrical profile in the longitudinal direction of the wire to be elongated. Upon closure of the pincer jaws, the wire will be centered and cut off by the central cutter 10. At the same time, due to the lateral cutting 11 on the one hand, the end of the finished part and on the other hand, the starting shape of the next part are shaped for formation of the ultimate shape of the head. The connection surface 12 between the parts of the insert 9 may be toothed or serrated, and the parts of the insert may be connected by a rivet or screw 5 that extends through an opening.

Although an illustrative embodiment of the present invention, and various modifications thereof, have been described in detail herein with reference to the accompanying drawings, it is to be understood that the invention is not limited to this precise embodiment and the described modifications, and that various changes and further modifications may be effected therein by one skilled in the art without departing from the scope or spirit of the invention as defined in the appended claims.

We claim:

1. A wear-resistant machine tool for the impact manufacture of nails, screws, rivets and similar items from a wire starting material, comprising:

a first tool insert, wherein the first tool insert is divided in a longitudinal direction, the division forming at least two parts, the longitudinal direction substantially the same as a feed direction of the wire starting material and further wherein the first tool insert mates with a second tool insert during use, and wherein the at least two parts further comprise hard metal.

2. A tool according to claim 1, wherein the at least two parts are connected to each other by a rivet or screw connection.

3. A tool according to claim 1, wherein the at least two parts are pressed together by means of a toolholder or a machine part in which they are employed.

4. A tool according to claim 1, wherein the at least two parts include partly toothed connection surfaces between said parts.

* * * * *

UNITED STATES PATENT AND TRADEMARK OFFICE

CERTIFICATE OF CORRECTION

PATENT NO. : 5,979,216

DATED : November 9, 1999

INVENTOR(S) : Michael Schretter *et al.*

It is certified that error appears in the above-identified patent and that said Letters Patent is hereby corrected as shown below:

On the Cover Page

[73] Assignee, please delete "Schwartzkopf Technologies, Corp." and insert therefor -- Schwarzkopf Technologies Corp. --.

Signed and Sealed this

Nineteenth Day of September, 2000

*Attest:*

Q. TODD DICKINSON

*Attesting Officer*

*Director of Patents and Trademarks*